US006193571B1

(12) United States Patent
Burg

(10) Patent No.: US 6,193,571 B1
(45) Date of Patent: Feb. 27, 2001

(54) ENHANCED WATERJET PROPULSOR

(76) Inventor: Donald E. Burg, 15840 SW. 84th Ave., Miami, FL (US) 33157

( * ) Notice: Subject to any disclaimer, the term of this patent is extended or adjusted under 35 U.S.C. 154(b) by 0 days.

(21) Appl. No.: 09/374,686

(22) Filed: Aug. 16, 1999

(51) Int. Cl.[7] ..... B63C 1/02; B63B 35/08
(52) U.S. Cl. ..... 440/47; 440/40
(58) Field of Search ..... 440/38, 40, 47, 440/42, 43; 114/55.5

(56) References Cited

U.S. PATENT DOCUMENTS 3,283,737 * 11/1966 Gongwer ..... 115/16
4,050,631 * 9/1977 Syltebo ..... 239/265.25
5,244,425 * 9/1993 Tasaki et al. ..... 440/47
5,460,553 * 10/1995 Craig et al. ..... 440/38
5,540,605 * 7/1996 Lin ..... 440/46
5,879,209 * 3/1999 Jones ..... 440/42

* cited by examiner

*Primary Examiner*—S. Joseph Morano
*Assistant Examiner*—Patrick Craig Muldoon
(74) *Attorney, Agent, or Firm*—Robert J. Van DerWall

(57) ABSTRACT

An improved waterjet propulsor that uses differential static pressure from the water flowing through and around the propulsor to provide additional thrust via internal and external vanes. Uniform water velocity is also created by the vanes within the propulsor. A boat trimming system is incorporated as part of the waterjet discharge nozzle.

27 Claims, 4 Drawing Sheets

ENHANCED WATERJET PROPULSOR

BACKGROUND OF THE INVENTION

Waterjet propulsors have been available for many years. Some of their obvious advantages over propellers include that they have no exposed rotor, have low underwater noise signature, offer even engine loading, and offer shallow draft. However, the waterjet's efficiency falls far short of the efficiency of an underwater propeller at low boat speeds. The propulsive coefficient of a typical underwater propeller at 16 knots is about 65 percent while that of a waterjet at the same 16 knots would be only about 40 percent. Those numbers given an advantage to the underwater propeller of 38 percent at that 16 knot speed. The waterjet becomes more competitive at higher speeds where the drag of the underwater propeller's appendages including shaft, strut, rudder, etc. causes it to have a severe disadvantage. The competition to the waterjet then becomes the surface propeller that, in its normal design, operates aft of the transom or a step in the boat's bottom. Only the lower half of the surface propeller is in the water. As such the surface propeller avoids shaft, thrust, and, in some designs, rudder drag. While generally considered to be rather inefficient at low boat speeds, the surface propeller is considered the favored propulsor at very high boat speeds.

The Kort Nozzle, first introduced in the 1930's, yields even greater performance for a variation of the propeller at low boat speeds. It applies a simple ringed nozzle around the periphery of an underwater propeller. By use of carefully designed angled airfoil shapes to the nozzle ring it is possible for the Kort nozzle to actually gain thrust from external forces acting on the nozzle. A well designed Kort nozzle shows noticeable performance gains over a standard underwater propeller at speeds up to, say, 16–20 knots. Beyond those speeds, the drag of the nozzle itself rules out use of the Kort nozzles. As such, Kort nozzles are widely applied to tug boats and other low speed mostly work boats. For purposes of this application, low speed is defined as boat speeds up to and including 20 knots and high speed as boat speeds of over 20 knots.

In summary, the waterjet propulsor is severely outclassed from efficiency standpoints at low to moderate, up to about 25 knot, and very high, over 60 knot, speeds. The reason for much of its efficiency shortcomings has to do with its inlet performance. A well-designed waterjet pump can have a rotor efficiency of 93 percent, flow straightening stator vane efficiency of 92 percent, and discharge nozzle efficiency of 98 percent. That comes to an overall pump efficiency of 84 percent. However, its averaged inlet pressure recovery efficiency will probably only be in the 70 percent area. Consequently, the best overall efficiency that can be expected from such a waterjet propulsor while running at its best performance at hihg boat speeds is about 59 percent. The major reason that waterjet inlet efficiency or inlet pressure recovery is so poor is because of distortion in the inlet flow. The high velocity incoming water in a typical flush with the hull waterjet inlet piles up over the lower half of the inlet duct. Due to this distorted flow, the rotor generally sees recoveries of 90 percent or more of boat freestream dynamic head over its lower half and as low as 50–60 percent over its upper half.

The instant invention offers greatly improved thrust values for the waterjet at all boat speeds. In its preferred embodiment, it decreases the amount of flow distortion that the rotor sees as well as gains thrust advantage from an airfoil shaped flow deflector strategically placed in the inlet duct. Further, generally airfoil shaping of the lower outside portion of the inlet housing so that such housing is submerged adds to thrust with little or no increase in external drag.

In addition to the significant performance gains in waterjet performance to be realized by the instant invention, a significant advantage in the form of a discharge jet-trimming device is also offered. These features are described in detail in the following sections.

SUMMARY OF THE INVENTION

With the foregoing in mind, it is the principal object of the preferred embodiment of the instant invention to provide a new waterjet propulsor that offers efficiencies competitive with or superior to the propeller at all boat speeds.

It is a related object of the invention that thrust enhancements shall be provided by specific arrangement and angling of the underside of the inlet of the waterjet.

It is a further object of the invention that a substantially transversely oriented divider shall be placed upstream of the rotor inlet to aid in directing flow to the rotor to thereby enhance rotor performance.

It is a directly related object of the invention that such a flow divider shall be, at least in part, airfoil shaped.

It is yet a further related object of the invention that such a flow divider shall have forces acting on it that add forward thrust to enhanced waterjet propulsor.

It is a further related object of the invention that said flow divider may be separated into two or more parts so that liquid flow can travel between upper and lower surfaces of the flow divider.

It is another object of the invention that a nozzle that has the ability to control the trim of the waterjet propulsor driven boat be offered.

It is a directly related object of the invention that movable nozzle elements disposed within a fixed nozzle structure can be used to apply trimming forces to the boat.

It is yet another directly related object of the invention that such movable nozzle elements are, at least partially, returned to their neutral positions by force of the water discharging from the nozzle.

It is a further related object of the invention that similar movable nozzle elements to those use for trim can be positioned to accomplish steering of the waterjet propelled boat.

It is yet another object of the invention that a steering rudder can be positioned aft of or at least partially internal to the fixed nozzle to accomplish steering of the boat.

DETAILED DESCRIPTION

Figure 1:
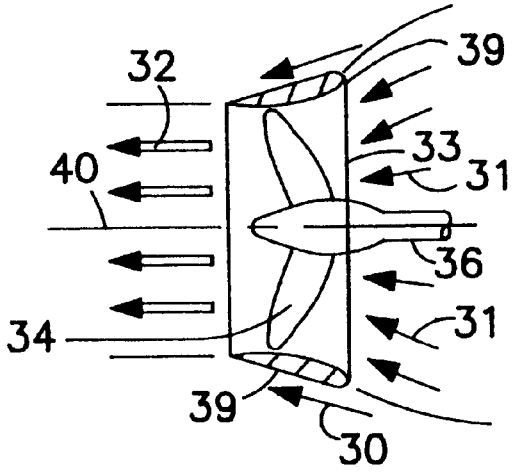
FIG. 1 PRIOR ART
FIG. 1 shows a centerline cross-sectional view of a Kort nozzle. This is prior art since the Kort nozzle was developed in the 1930s. As can be seen this is actually a propeller in a nozzle ring. It is disposed below the hull of a boat (not shown).

FIG. 1 presents a centerline cross-sectional view of the prior art Kort nozzle 33. This is simply a rotor in the form of a propeller 34 in a nozzle ring 39 disposed below the hull of a boat (not shown). Also shown are the propeller drive shaft 36, inlet water velocity arrows 31, discharge jet water velocity arrows 32, external water velocity arrows 30, and a horizontal transverse centerline plane 40. The Kort nozzle 33 is noted for generating more thrust than an open water propeller at low boat speeds. The reasons for this are explained under the discussion of FIG. 2 that follows.

Figure 2:
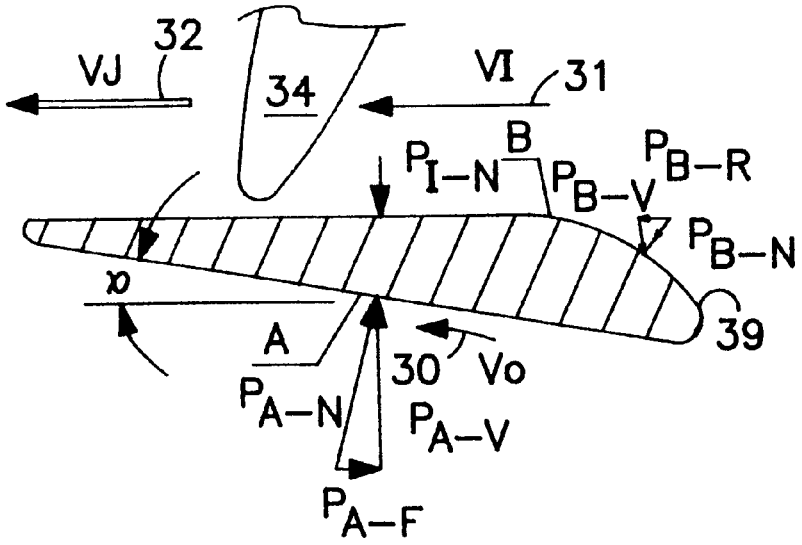
FIG. 2 PRIOR ART
FIG. 2 presents and enlarged view of the lower portion of the Kort nozzle ring cross-section that was shown in FIG. 1. Note that this nozzle ring is actually at least partially airfoil shaped and that its outer surface is angled inward from forward to aft. This shaping of the nozzle ring is largely responsible for the greatly improved efficiency realized by the Kort nozzle at low boat speeds compared to an open water propeller.

FIG. 2 presents and enlarged view of the lower portion of the Kort nozzle ring 39 cross-section that was shown in FIG. 1. Note that is nozzle ring 39 is actually at least partially airfoil shaped and that its outer or lower surface A is angled upward from forward to aft in this illustration. The water flow, as depicted by inlet water velocity arrow 31, entering the inside of the nozzle ring 39 that is being acted upon by the propeller 34 is obviously traveling at a much greater velocity (VB)—normally about 1.5 times—than the outside velocity (VA).

The vector force arrows shown in FIG. 2 are defined as follows: PA-N is the external static pressure normal to surface A, PA-V is the external static pressure vertical to surface A, and PA-F is the external static pressure force in a forward direction acting on surface A. PB-N is the internal static pressure force normal to internal surface B, PB-V is the internal static pressure force vertical to surface B, and PB-R is the internal static force acting rearward. It has been found by test and application of Kort nozzles over the years that the favored value for angle $\alpha$ is generally about nine degrees.

By Bernoulli's equation, neglecting minor elevation considerations, total pressure is made up of static pressure and dynamic pressure. Dynamic pressure is a function of velocity squared so even minor velocity differences make for big changes in dynamic and hence static pressure. As such, there is more static pressure on the outer surface (A) than the inner surface (B) of the nozzle ring. Since the outer surface (A) is angled outward there is a forward force on outer surface (A). This is calculated by simply multiplying the external surface area of A by the external static pressure forward (PA-F). Importantly, most of the inner surface (B) is parallel to the water flow so there is no forward force on that parallel portion of surface (B). Therefore, there is a resultant positive forward force on the entire nozzle ring 39 that accounts for at least most of the higher efficiencies of the Kort nozzle compared to a standard open water propeller.

The positive forward force acting on the Kort nozzle ring 39 makes for greatly improved performance compared to an open water propeller up to vessel speeds of, say, 18 knots or so. At that speed the drag of the nozzle ring exceeds the positive forward force generated by the nozzle ring 39 resulting in the open water propeller being favored.

Figure 3:
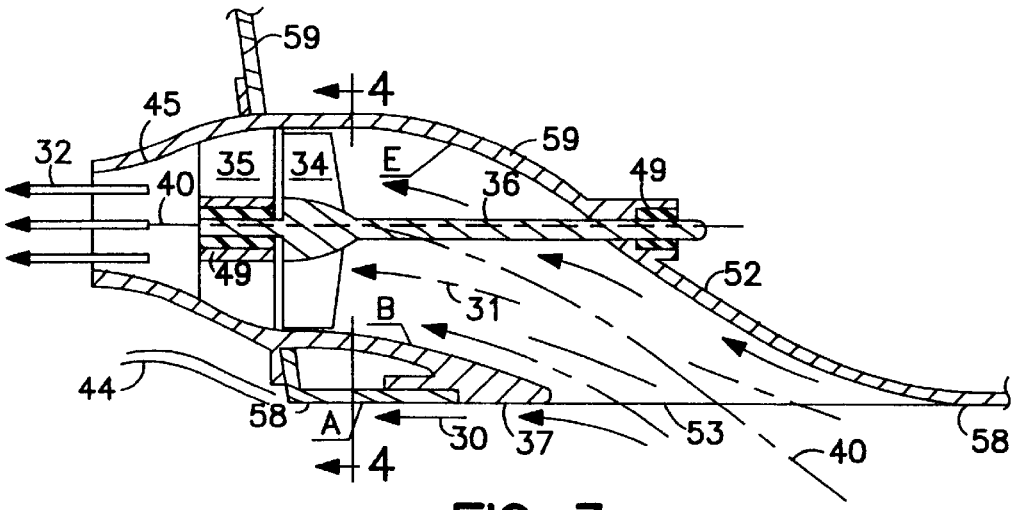
FIG. 3 PRIOR ART
FIG. 3 presents a centerline cross-sectional view of a typical prior art waterjet propulsor.

FIG. 3 presents a centerline cross-sectional view of a typical prior art waterjet propulsor 51. Items shown are the shaft 36, rotor 34, stator vanes 35, bearings 49, typical boat keel 58, boat transom 59, discharge nozzle 45, waterline 44, lower inlet housing 37. Note that the transverse centerline plane 40 bisects the housing 52 and therefore bends downward going forward from the rotor 34 to the plane of the inlet 53. Note also that the boat keel 58 may be located otherwise with either more or less of the waterjet either above or below the boat keel 58. Further, various portions of the waterjet from virtually none to all of the waterjet may be disposed aft of the boat transom 59.

The lower portion of a prior art waterjet propulsor 51 inlet housing 37 is especially designed to keep water away from the discharge jet, as shown by discharge jet velocity arrows 32, and its steering and reversing system (not shown to simplicity the drawings). This can be seen by shape of the waterline 44. As such, the lower portion of the inlet housing 37, noted here as surface A, is not angled and does not extend to the aft end of the nozzle as does surface A of the Kort nozzle shown in FIG. 2. Therefore, there is little or none of the positive forward external force on surface A as is experienced by the Kort nozzle. There is however a forward force generated on an upper portion of the housing, depicted by surface E, in the waterjet. This is discussed further in the following paragraphs that describe FIGS. 4 and 5.

Figure 4:
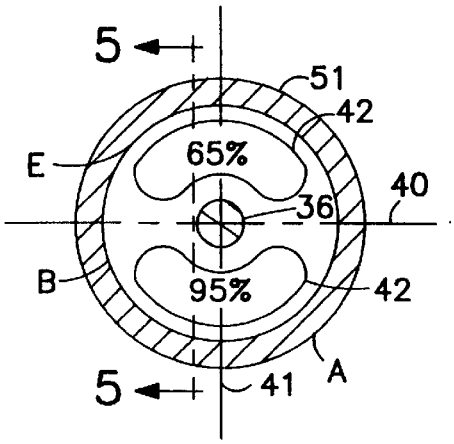
FIG. 4 PRIOR ART
FIG. 4 is a cross-sectional view, as taken through line 4—4 of FIG. 3, that shows areas of approximate equal dynamic pressures in a transverse plane just upstream of the rotor inlet in a typical state-of-the-art waterjet. Note that such severely distorted velocity patterns just upstream of the rotor are typical in prior art waterjets.

FIG. 4 is a cross-sectional view, as taken through line 4—4 of FIG. 3, that shows approximate equal dynamic pressure areas 42 as seen in a plane just upstream of the rotor inlet of the prior art waterjet 51. Note that such severely distorted velocity patterns just upstream of the rotor are typical in prior art waterjets. This particular illustration shows mostly 95 percent velocity recovery in the lower half and a majority of recovery at 65 percent over the upper half. The reason for this effect is that the inlet flow tends to pile up in the lower half—this is especially true at higher vehicle speeds. Note that surface B is defined as extending below and up to the transverse horizontal plane 40 while surface E extends above the transverse horizontal plane 40. Also shown in FIG. 4 is a vertical centerline plane 41.

Figure 5:
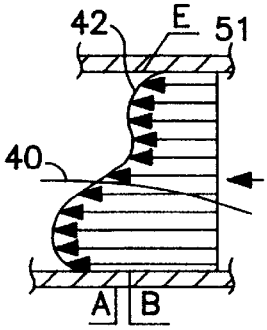
FIG. 5 PRIOR ART
FIG. 5 shows a partial cross-sectional view, as taken through line 5—5 of FIG. 4, that illustrates the typical velocity profiles just upstream of the rotor inlet in a prior art waterjet.

FIG. 5 shows a partial cross-sectional view, as taken through line 5—5 of FIG. 4, that illustrates the typical velocity profiles 42 just upstream of the rotor inlet in a prior art waterjet 51. Since the velocity over upper surface E is substantially less than the velocity over lower surface B, there is a noticeably higher static pressure acting on surface E. This is, again, verified by Bernoulli's equation as is noted earlier in the discussion about the forces acting on the Kort nozzle under the paragraphs about FIG. 2. Referring back to FIG. 3, it is to be noted that surface E is not only seeing a higher static pressure but is also larger than surface B and is angling downward so that there is a net forward thrust on the waterjet housing. The fore and aft forces on surface A are negligible or actually may slightly rearward since surface A is substantially horizontal or angled downward from front to rear due to trim of the driven boat.

So there is actually a net positive forward force occurring over the inlet housing of a prior art waterjet. This has been confirmed by static pressure measurements made on the inside surfaces of the housings of a large waterjet.

Figure 6:
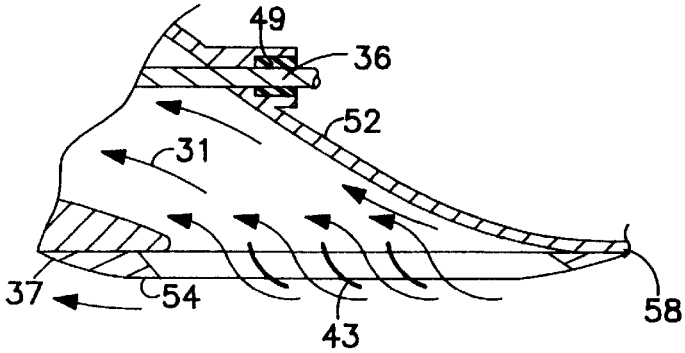
FIG. 6 PRIOR ART
FIG. 6 is a partial cross-sectional view of a similar prior art waterjet propulsor as presented in FIG. 3. This view shows the addition of turning vanes set in a grille arrangement that are used to direct water from outside the hull into the waterjet inlet. These prior art turning vanes are sometimes applied to waterjets in Personnel WaterCraft (PWC) used in closed course racing.

FIG. 6 is a partial cross-sectional view of a similar prior art waterjet propulsor 51 as presented in FIG. 3. This view shows the addition of turning vanes 43 set in an inlet grille 54 that are used to direct water from outside the hull into a waterjet inlet 53. These prior art turning vanes 43 are sometimes applied to waterjets in Personnel WaterCraft (PWC). The purpose of the turning vanes 43 is to ram water into the PWC waterjet inlet 53 during closed course racing. Such turning vanes are effective in ramming water into the waterjet to thereby increase acceleration of the PWC around race course buoys. However, the drag of the turning vanes actually reduces the top speed of the PWC noticeably. Therefore, these turning vanes are not employed in waterjets except for the niche application of PWC's used in closed course races.

Figure 7:
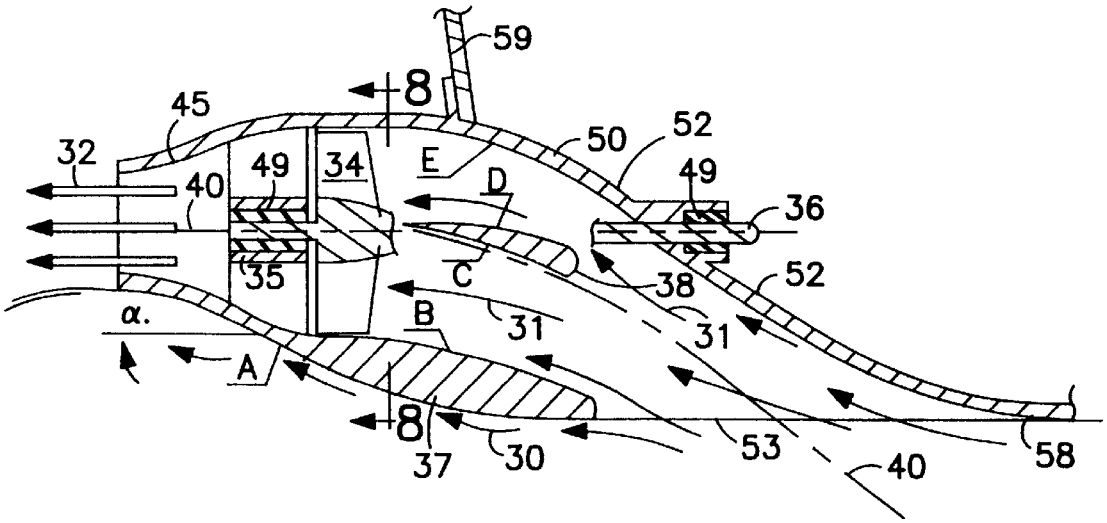
FIG. 7 is a cross-sectional view of the preferred embodiment of the instant invention enhanced waterjet propulsor. Note the aft angling surface of the lower outside portion of the inlet housing and the airfoil shaped divider disposed in the inlet. Both are important features that add to the enhanced performance of the instant invention. The airfoil shaped vane actually yields a positive thrust effect.

FIG. 7 is a cross-sectional view of the preferred embodiment of the instant invention enhanced waterjet propulsor 50. Note the aft upward angling surface of the lower outside portion of the inlet housing A and the at least partially airfoil shaped divider 38 disposed in the housing 52. Both are important features that add to the enhanced performance of the instant invention.

The, at least partially airfoil shaped, lower inlet housing 37 acts in a similar manner to the lower portion of the nozzle ring of the Kort nozzle as was described in the discussion of FIG. 2 earlier. This results in a net forward thrust when algebraically adding the forces acting on surface A and surface B. However, very importantly, since this is a low drag at high speed inlet design there is little or no external drag penalty at high boat speeds as is the case with the Kort nozzle ring. The aft rising angle $\alpha$ is generally to be kept at less than 18 degrees with an angle of less than 12 degrees preferred. It is intended that surface A, as seen here in a transverse plane perpendicular to a centerline of the rotor shaft 36, can be curvilinear, flat, V-shaped, or any combination of such shapes so long as, on average, it angles upward going aft over its longitudinal length.

The low drag at least partially airfoil shaped divider 38 disposed in the housing 52 provides twofold advantage. First, it provides an evening of the velocity profiles at the rotor 34 inlet which aids overall efficiency and second, it offers a resultant net positive forward force based on the algebraic adding of the static pressure forces acting on its lower surface C and its upper surface D. It is very important to realize that the forward end of the generally airfoil shaped divider 38, while normally sloping downward, is actually acting on water flow that is already being directed upward as can be seen by examination of the orientation of the inlet water velocity arrows 31. As such, it is actually at a zero or relatively small angle of attack reference to the incoming water flow. As such, there is little or none of the drag forces experienced by the inlet turning vanes that were described in the discussion of FIG. 6. Analysis of the static pressure forces acting on surfaces C and D takes the same general form as the analysis presented in the discussion of FIG. 2 so such analysis will not be presented here for sake of brevity. Further, it is a stated intent of the preferred embodiment of the instant invention that the inlet divider 38 at least in its majority, starts aft of the inlet plane 53 and terminates less than one rotor diameter forward of the rotor 34.

Figure 8:
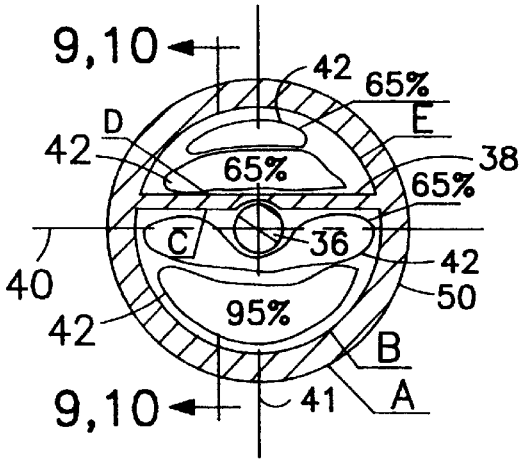
FIG. 8 is a cross-sectional view, as taken through line 8—8 of FIG. 7, that shows areas of approximately equal dynamic pressures in a transverse plane just upstream of the rotor inlet. Note that velocity distortions are, on average, less severe than for the prior art waterjet situation presented in FIG. 4. This is attributed to the flow-directing vane(s) that connects the internal sides of the housing.

FIG. 8 is a cross-sectional view, as taken through line 8—8 of FIG. 7, that shows areas of approximately equal dynamic pressures in a plane just upstream of the rotor inlet for the preferred embodiment of the instant invention. Note that the velocity distortions are, on average, noticeably less severe than for the prior art waterjet situation presented in FIG. 4. This is attributed to the flow-directing vane 38 that, in this preferred embodiment, transversely connects the internal sides of the housing.

Figure 9:
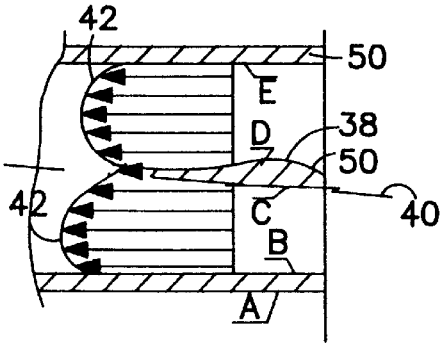
FIG. 9 shows a partial cross-sectional view, as taken through line 9—9 of FIG. 8, that illustrates the typical velocity profiles just upstream of the rotor inlet in a waterjet to the instant invention. Note that there is much more high-energy water arriving at the upper portion of the rotor inlet here than for the prior art waterjet situation presented in FIG. 5.

FIG. 9 shows a partial cross-sectional view, as taken through line 9—9 of FIG. 8, that illustrates the typical velocity profiles 42 just upstream of the rotor inlet in an enhanced waterjet to the instant invention. Note that there is much more high-energy water arriving at the upper portion of the rotor inlet here than for the prior art waterjet situation presented in FIG. 5. Due to the lower velocity water adjacent to surfaces A, C, and E, such surfaces see higher static pressures than upper surfaces B and D. The result is, because of the carefully selected aft upward sloping shapes of surfaces A, C, and E, a net forward thrust acting on the surfaces of the waterjet when it is propelling a boat forward at any speed. However, it is obvious that the forward thrust effect on external surface A will decrease with increasing boat speed. For example, the ratio of internal velocity over surface B to external velocity over surface A is about 2.5 at 16 knots and only about 1.4 at 40 knots for a typical waterjet to the preferred embodiment of the instant invention.

Figure 10:
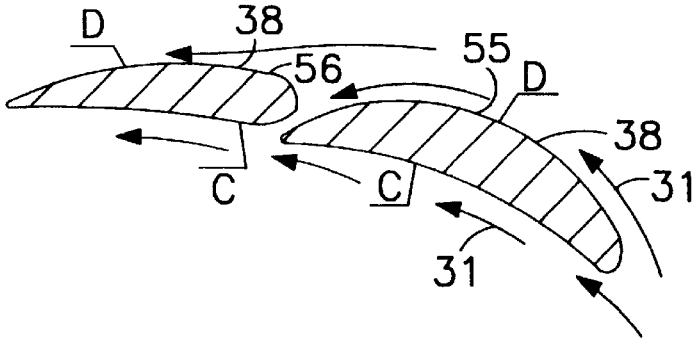
FIG. 10 is a partial cross-sectional view, as taken through line 10—10 of FIG. 8 that shows an optional preferred divider vane concept. In this case separation of forward and aft portions of the vane into two separate units allows water flowing over the top portion to be directed to the lower portion. This offers advantages by controlling the boundary layer over the top portion of the divider vane. It is also possible to design the separation so that flow is from the bottom portion to the top portion of the vane if such offers a performance advantage.

FIG. 10 is a partial cross-sectional view, as taken through line 10—10 of FIG. 8 that shows an optional preferred divider vane 38 concept. In this case separation of forward and aft portions of the divider vane 38 into a forward portion 55 and aft portion 56 allows water flowing over the top portion to be directed to the lower portion or vice versa. This offers advantages by controlling the boundary layer over the top portion of the divider vane. Any number of portions of divider vane may, of course, be used.

Figure 11:
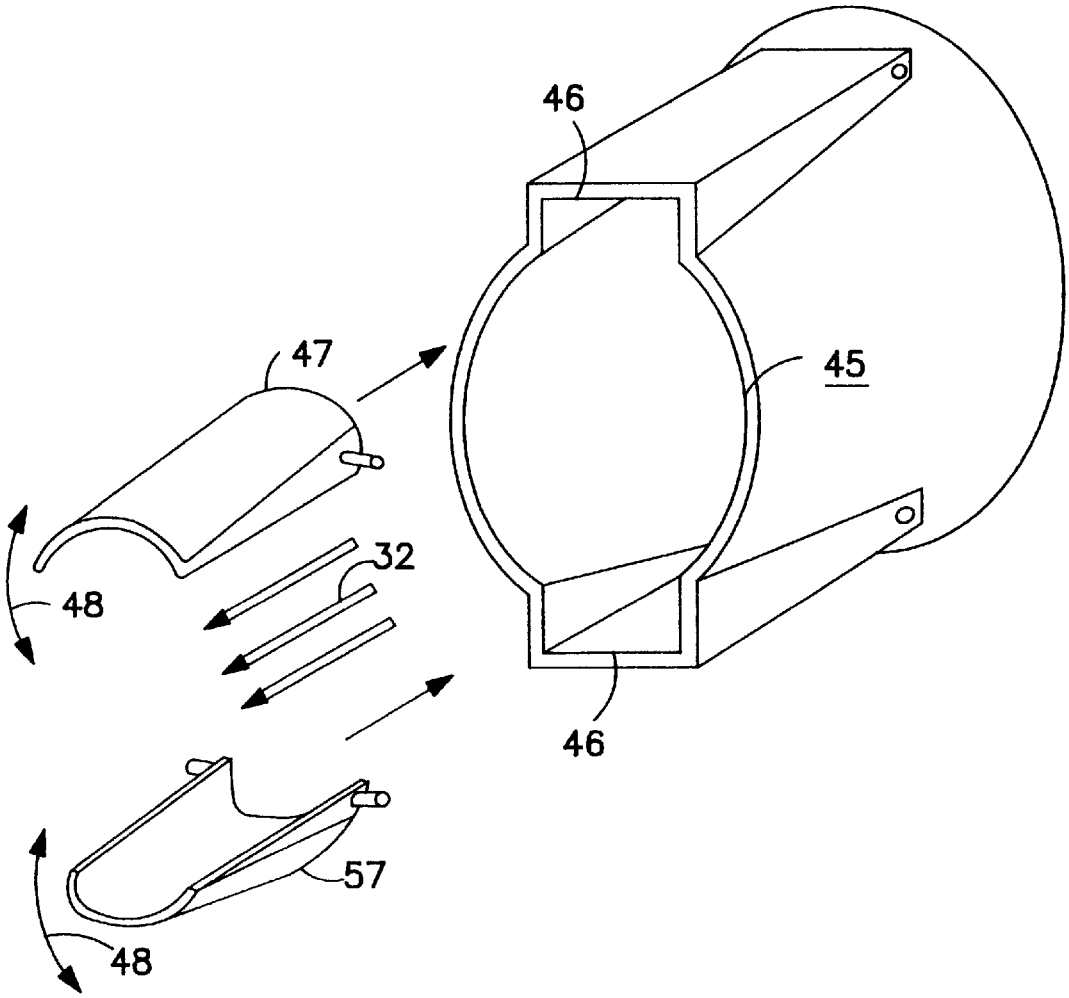
FIG. 11 presents an isometric view of a trimmable nozzle concept that can be applied to any jet discharge. In this preferred embodiment of a conical nozzle arrangement, either the upper or lower nozzle flap can be actuated to give an up or a down trim effect on the driven boat. While not shown, it is possible to also use such nozzle flaps on either side to act as steering means.

FIG. 11 presents an isometric view of a trimmable nozzle 45 that can be applied to the discharge of any jet. In this preferred embodiment of a conical nozzle arrangement, either an upper trim control element 47 or a lower trim control element 57 can be actuated to give an up or a down trim effect on the driven boat. Major advantages of this inventive approach nozzle over a fully articulated nozzle are that: 1) construction is very simple, 2) control system and actuators are less complicated, and 3) there is little or no back flow leakage. The back flow leakage associated with an articulated nozzle results in a loss of efficiency. While not shown in FIG. 11, it is possible to also use such control flap like elements on either side of a discharge nozzle to act as steering means and/or to use a rudder element disposed in the discharge jet as steering means.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by appended claims, which are the sole definition of the invention.

What I claim is:

1. In an enhanced waterjet propulsor that is installed, at least in part, above a keel of a boat driven by said enhanced waterjet propulsor, the improvement comprising:

an external lower surface emanating from an inlet of said enhanced waterjet propulsor, on average over its longitudinal length and as seen with the enhanced waterjet propulsor propelling the boat forward, angles upward toward a discharge jet of said enhanced waterjet propulsor to thereby allow static pressure in water adjacent to said external lower surface to exert a forward force on said external lower surface that exceeds a force exerted by static pressure on an internal lower surface emanating from an inlet of said enhanced waterjet propulsor.

2. An enhanced waterjet propulsor of claim 1 wherein an average angle that the external lower surface angles upward is defined as being less than 18 degrees.

3. The enhanced waterjet propulsor of claim 1 wherein an average angle that the external lower surface angles upward is defined as being less than 12 degrees.

4. The enhanced waterjet propulsor of claim 1 which further comprises a divider member disposed, at least in its majority, internal to an inlet of said enhanced waterjet propulsor and wherein said divider member directs incoming water to a water-energizing rotor.

5. The enhanced waterjet propulsor of claim 4 wherein a lower surface of said divider member, on average over its longitudinal length and as seen with the enhanced waterjet propulsor propelling the boat forward, angles upward toward said rotor whereby static pressure on the lower surface of said divider member exerts a forward force that exceeds a static pressure force on an upper surface of said divider member to thereby result in a net positive forward force.

6. The enhanced waterjet propulsor of claim 4 wherein said divider member is at least in part airfoil shaped.

7. The enhanced waterjet propulsor of claim 4 wherein said divider member, at least in its majority, is disposed aft of an inlet plane of said enhanced waterjet propulsor and terminates within a distance of one rotor diameter forward of the rotor.

8. The enhanced waterjet propulsor of claim 4 wherein said divider member is made up of two or more elements.

9. The enhanced waterjet propulsor of claim 1 which further comprises a discharge nozzle disposed aft of a rotor of said enhanced waterjet propulsor and fixed in position relative to said enhanced waterjet propulsor, an element of a lower surface of said discharge nozzle movable in an upward direction relative to the discharge nozzle to thereby provide a downward trimming force to an aft end of the boat, and an element of an upper surface of said discharge nozzle movable in a downward direction relative to the discharge nozzle to thereby provide an upward trimming force to the aft end of the boat.

10. The enhanced waterjet propulsor of claim 9 which further comprises an element of a port side surface of said discharge nozzle movable in an inward direction relative to the discharge nozzle to thereby provide a port directed steering force to an aft end of the boat, and an element of a starboard side surface of said discharge nozzle movable in an inward direction relative to the discharge nozzle to thereby provide a starboard steering force to the aft end of the boat.

11. In an enhanced waterjet propulsor that is installed, at least in part, above a keel of a boat driven by said enhanced waterjet propulsor, the improvement comprising:

a divider member disposed, at least in its majority, internal to an inlet of said enhanced waterjet propulsor and wherein said divider member directs incoming water to a water-energizing rotor, a lower surface of said divider member, on average over its longitudinal length and as seen with the enhanced waterjet propulsor propelling the boat forward, angles upward toward said rotor whereby static pressure on the lower surface of said divider member exerts a forward force that exceeds a static pressure force on an upper surface of said divider member to thereby result in a net positive forward force.

12. The enhanced waterjet propulsor of claim 11 wherein said divider member is, at least in its majority, transversely oriented.

13. The enhanced waterjet propulsor of claim 11 wherein said divider member is at least in part airfoil shaped.

14. The enhanced waterjet propulsor of claim 11 wherein said divider member, at least in its majority, is disposed aft of an inlet plane of said enhanced waterjet propulsor and terminates within a distance of one rotor diameter forward of the rotor.

15. The enhanced waterjet propulsor of claim 11 wherein said divider member is made up of two or more elements.

16. The enhanced waterjet propulsor of claim 11 wherein an external lower surface emanating from an inlet of said enhanced waterjet propulsor, on average over its longitudinal length and as seen with the enhanced waterjet propulsor propelling the board forward, angles upward toward a discharge jet of said enhanced waterjet propulsor to thereby allow static pressure in water adjacent to said external lower surface to exert a forward force on said external lower surface that exceeds a force exerted by static pressure on an internal lower surface emanating from an inlet of said enhanced waterjet propulsor.

17. The enhanced waterjet propulsor of claim 16 wherein an average angle that the external lower surface angles upward is defined as being less than 18 degrees.

18. The enhanced waterjet propulsor of claim 16 wherein an average angle that the external lower surface angles upward is defined as being less than 12 degrees.

19. The enhanced waterjet propulsor of claim 11 which further comprises a discharge nozzle disposed aft of a rotor of said enhanced waterjet propulsor and fixed in position relative to said enhanced waterjet propulsor, an element of a lower surface of said discharge nozzle movable in an upward direction relative to the discharge nozzle to thereby provide a downward trimming force to an aft end of the boat, and an element of an upper surface of said discharge nozzle movable in a downward direction relative to the discharge nozzle to thereby provide an upward trimming force to the aft end of the boat.

20. The enhanced waterjet propulsor of claim 19 which further comprises an element of a port side surface of said discharge nozzle movable in an inward direction relative to the discharge nozzle to thereby provide a port directed steering force to an aft end of the boat, and an element of a starboard side surface of said discharge nozzle movable in an inward direction relative to the discharge nozzle to thereby provide a starboard steering force to the aft end of the boat.

21. In an enhanced waterjet propulsor that is installed, at least in part, above a keel of a boat driven by said enhanced waterjet propulsor, the improvement comprising:

a discharge nozzle disposed aft of a rotor of said enhanced waterjet propulsor and fixed in position relative to said enhanced waterjet propulsor, an element of a lower surface of said discharge nozzle movable in an upward direction relative to the discharge nozzle to thereby provide a downward trimming force to an aft end of the boat, and an element of an upper surface of said discharge nozzle movable in a downward direction relative to the discharge nozzle to thereby provide an upward trimming force to the aft end of the boat.

22. The enhanced waterjet propulsor of claim 21 which further comprises an element of a port side surface of said discharge nozzle movable in an inward direction relative to the discharge nozzle to thereby provide a port directed steering force to an aft end of the boat, and an element of a starboard side surface of said discharge nozzle movable in an inward direction relative to the discharge nozzle to thereby provide a starboard steering force to the aft end of the boat.

23. The enhanced waterjet propulsor of claim 21 that further comprises a steering rudder that is movable in relation to the discharge nozzle.

24. The enhanced waterjet propulsor of claim 21 wherein an external lower surface emanating from an inlet of said enhanced waterjet propulsor, on average over its longitudinal length and as seen with the enhanced waterjet propulsor propelling the boat forward, angles upward toward a discharge jet of said enhanced waterjet propulsor to thereby allow static pressure in water adjacent to said external lower surface to exert a forward force on said external lower surface that exceeds a force exerted by static pressure on an internal lower surface emanating from an inlet of said enhanced waterjet propulsor.

25. The enhanced waterjet propulsor of claim 21 which further comprises a divider member disposed, at lest in its majority, internal to an inlet of said enhanced waterjet propulsor and wherein said divider member directs incoming water to a water-energizing rotor, a lower surface of said divider member, on average over its longitudinal length and as seen with the enhanced waterjet propulsor propelling the boat forward, angles upward toward said rotor whereby static pressure on the lower surface of said divider member exerts a forward force that exceeds a static pressure force on an upper surface of said divider member to thereby result in a net positive forward force.

26. The enhanced waterjet propulsor of claim 21 wherein said discharge nozzle, at least in part, converges internally going from its forward to aft portions.

27. The enhanced waterjet propulsor of claim 21 wherein said discharge nozzle is, at least partially, in the form of a truncated cone.

* * * * *